US010694916B2

(12) United States Patent
Gonzales et al.

(10) Patent No.: US 10,694,916 B2
(45) Date of Patent: Jun. 30, 2020

(54) METHOD OF MANUFACTURING AN ABRASIVE SPONGE FOR CLEANING

(71) Applicant: The Procter & Gamble Company, Cincinnati, OH (US)

(72) Inventors: Denis Alfred Gonzales, Brussels (BE); Aicha Dkidak, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 256 days.

(21) Appl. No.: 15/727,092

(22) Filed: Oct. 6, 2017

(65) Prior Publication Data

US 2018/0153368 A1 Jun. 7, 2018

Related U.S. Application Data

(60) Provisional application No. 62/404,858, filed on Oct. 6, 2016.

(51) Int. Cl.
*A47L 13/16* (2006.01)
*B08B 3/04* (2006.01)

(52) U.S. Cl.
CPC ..... *A47L 13/16* (2013.01); *B08B 3/04* (2013.01)

(58) Field of Classification Search
None
See application file for complete search history.

(56) References Cited

U.S. PATENT DOCUMENTS 4,111,666 A * 9/1978 Kalbow ..... A47L 13/16 51/295
4,160,076 A * 7/1979 Guthrie ..... C08G 18/4833 516/DIG. 1
4,581,287 A * 4/1986 Smith ..... A47L 13/16 15/209.1
2002/0193459 A1* 12/2002 Haseyama ..... B29C 44/348 521/155
2007/0061991 A1* 3/2007 Gonzales ..... A47L 13/16 15/244.4
2009/0276971 A1* 11/2009 Nozari ..... A47L 13/16 15/118

(Continued)

FOREIGN PATENT DOCUMENTS

EP 0010408 A1 4/1980
EP 2338962 A1 6/2011

(Continued)

OTHER PUBLICATIONS

Case AA1091 Search Report; Serial No. PCT/US2017/055570; dated Feb. 5, 2018; 12 Pages.

(Continued)

*Primary Examiner* — Colleen P Dunn
*Assistant Examiner* — Ross J Christie
(74) *Attorney, Agent, or Firm* — Abbey A. Lopez

(57) ABSTRACT

A method of manufacturing an abrasive sponge for cleaning, the method comprising the steps of:

a) applying a cross-linking agent comprising one or more cyanoacrylate or isocyanate groups per molecule of crosslinking agent and mixtures thereof on at least a portion of a surface of a foam body comprising a open-cell foam material; and b) curing the cross-linking agent to form an abrasive layer on the at least a portion of the surface of the foam body.

18 Claims, 2 Drawing Sheets

FIG. 1A

(56) References Cited

U.S. PATENT DOCUMENTS

| | | | | |
|---|---|---|---|---|
| 2014/0295135 | A1* | 10/2014 | Thompson, Jr. | B32B 3/266<br>428/138 |
| 2015/0087737 | A1* | 3/2015 | Srivastava | C08G 18/4837<br>521/159 |

FOREIGN PATENT DOCUMENTS

| | | | |
|---|---|---|---|
| WO | WO2006065411 | A1 | 6/2006 |
| WO | WO2010118320 | A2 | 10/2010 |
| WO | WO2011056632 | A3 | 9/2011 |
| WO | WO2012115869 | A2 | 8/2012 |
| WO | WO2016004159 | A1 | 1/2016 |
| WO | WO2016137712 | A1 | 9/2016 |

OTHER PUBLICATIONS

Case AA1092 Search Report; Serial No. PCT/US2017/055571; dated Feb. 9, 2018; 12 Pages.
U.S. Appl. No. 15/727,111, filed Oct. 6, 2017, Denis Alfred Gonzales.

* cited by examiner

METHOD OF MANUFACTURING AN ABRASIVE SPONGE FOR CLEANING

FIELD OF THE INVENTION

The invention relates to a method of manufacturing an abrasive sponge for cleaning and an abrasive sponge manufactured by the method and a method of cleaning a surface with an abrasive sponge manufactured by the method.

BACKGROUND OF THE INVENTION

Composite cleaning sponges have been developed to remove food deposits which adhere to the dishware. For example, the composite cleaning sponge may comprise a foam layer and a layer of fibers made from natural or synthetic fibers (also known as a scouring pad) affixed to the foam layer by an adhesive. The scouring pad is known to be effective in removing caked-on soil such as food from dish surfaces. However, additional process steps are required to attach the scouring pad to the foam layer. Furthermore, the scouring pad is often too abrasive and may cause damage to the dish surfaces such as a non-stick coating such as a Teflon™ coating on a frying pan. The scouring pad is also less porous and acts against the deformability of the sponge as well as forms an additional barrier for water and detergent absorption by the sponge.

EP 0010408 describes a method of producing an abrasive surface on a sheet of compressible open-cell foam material for cleaning. The method comprises applying a hardenable resin such as an epoxy resin to a surface of the foam sheet through a stencil having holes arranged on the surface of the sheet. After hardening of the epoxy resin, a pattern of regions of hardened resin is formed on the surface of the foam sheet. However, the hardened resin also covers and clogs pores of the surface on which it is formed and this prevents water and/or soil from passing through the foam sheet. Therefore problems of water and detergent absorption by a sponge remain.

Accordingly, there is a need for a method of manufacturing an abrasive sponge which provides effective cleaning of the surfaces to be cleaned with minimal damage to the surfaces.

SUMMARY OF THE INVENTION

The present invention relates to a method of manufacturing an abrasive sponge for cleaning, the method comprising the steps of:

a) applying a cross-linking agent comprising one or more cyanoacrylate or isocyanate groups per molecule of cross-linking agent and mixture thereof on at least a portion of a surface of a foam body comprising an open-cell foam material; and b) curing the cross-linking agent to form an abrasive layer on the at least a portion of a surface of the foam body.

The above method provides an abrasive sponge with an abrasive layer having a hardness suitable for cleaning household surfaces while having in-situ sharp edges for efficient cleaning without damage to the household surfaces. Specifically, the foam body comprises foam struts and by incorporating the cross-linking agent comprising one or more cyanoacrylate or isocyanate groups on a surface of the foam body, the cross-linking agent reacts with the foam body and hardens the foam struts so that the physical properties of the foam are modified thereby. In particular, the hardened foam struts form the abrasive layer which is hard and sharp enough to provide excellent abrasive cleaning properties while provide good surface safety, i.e. relatively less damage to surfaces. This results in an abrasive sponge with improved properties like abrasiveness and hardness relative to a conventional foam sponge, the properties of the abrasive sponge can be adapted to suit different consumer needs by varying the number of dots in the array and an amount of the cross-linking agent accordingly. Therefore, flexibility in manufacturing can be achieved as the same facilities for manufacturing a sponge with one level of abrasiveness can be easily adapted or reapplied to manufacturing a sponge with a different level of abrasiveness.

In addition, the method also provides a simple and fast way of making an abrasive sponge for cleaning as the method does not require additional lamination, deposition or gluing of a scouring pad to a foam and the cross-linking agent can be cured at low temperatures in a relatively short time. For example, the cross-linking agent may be cured at a temperature between 10° C. to 50° C. in a curing time of from about 0.1 minutes (6 seconds) to about 30 minutes, preferably 0.2 minutes (12 seconds) to about 5 or 10 minutes. In particular, the cross-linking agent may be cured in about 0.2 minutes (20 seconds) at room temperature (approximately 25° C.).

DETAILED DESCRIPTION OF THE INVENTION

All percentages, ratios and proportions used herein are by weight percent unless otherwise specified.

As used herein, "abrasive sponge" refers to an article of manufacture according to a method of manufacturing an abrasive sponge according to the present invention. The abrasive sponge may be configured to be of any suitable shape and/or size and/or volume suitable for cleaning dish surfaces and household hard surfaces and for use with liquid detergent compositions.

As used herein "liquid detergent composition" refers to those compositions that are employed in a variety of cleaning uses including dishes, household hard surfaces (e.g., floors, countertops etc) and the like. A preferred liquid detergent composition for use with an abrasive sponge of the present invention is a "liquid dish detergent composition," which refers to those compositions that are employed in manual (i.e. hand) dish washing. Such compositions are generally high sudsing or foaming in nature.

As used herein "dish surfaces" refers to any kind of surfaces found in dish cleaning, such as dishes, cutlery, cutting boards, pans, and the like. Such dish surfaces may be found both in private households as well as in commercial, institutional and industrial environments.

As used herein "household hard surfaces" refers to any kind of surface typically found in and around houses like kitchens, bathrooms, e.g., floors, walls, tiles, windows, cupboards, sinks, showers, shower plasticized curtains, wash basins, WCs, fixtures and fittings and the like made of different materials like ceramic, vinyl, non-wax vinyl, linoleum As used herein "Shore® D hardness" refers to hardness of a material determined according to ASTM D2240-05 (2010). Shore® D hardness measurement may be carried out by using an ASTM durometer, such as the Type D Style Durometer available from Pacific Transducer Corp. of Los Angeles, Calif., or from ELECTROMATIC Equipment Co., Inc. 600 Oakland Ave Cedarhurst, N.Y. 11516.

Figure 1:
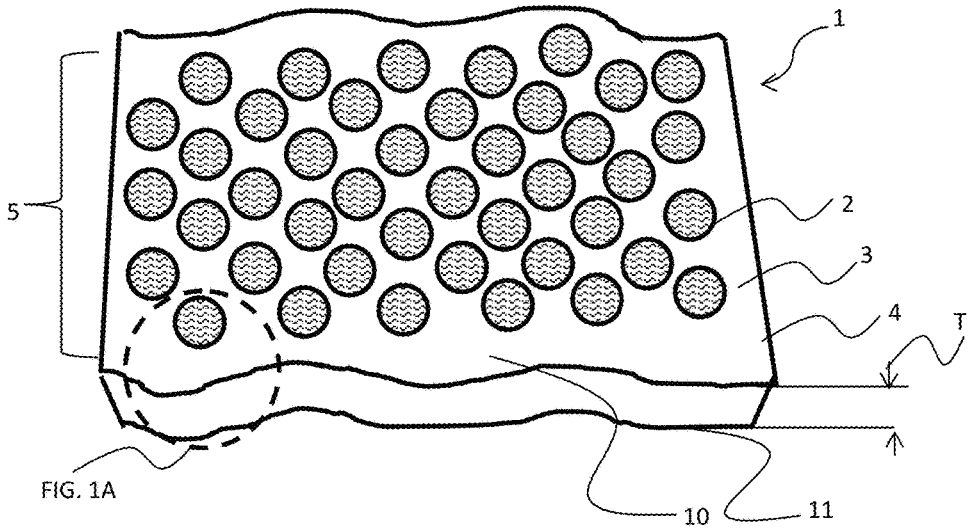
FIG. 1 is a schematic perspective view of an abrasive sponge according to the present invention.
Figure 1A:
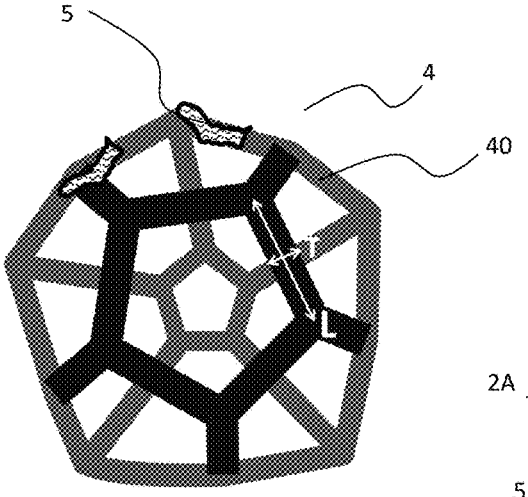
FIG. 1A is a schematic section view of foam struts of a portion of the abrasive sponge of FIG. 1.

The present invention relates to a method of manufacturing an abrasive sponge which is porous, permeable, provides good abrasive cleaning while securing surface safety of hard surfaces in the household. FIG. 1 shows a schematic view of an abrasive sponge 1 and FIG. 1A is a schematic section view of foam struts 40 of a portion of the abrasive sponge of FIG. 1.

Figure 2A:
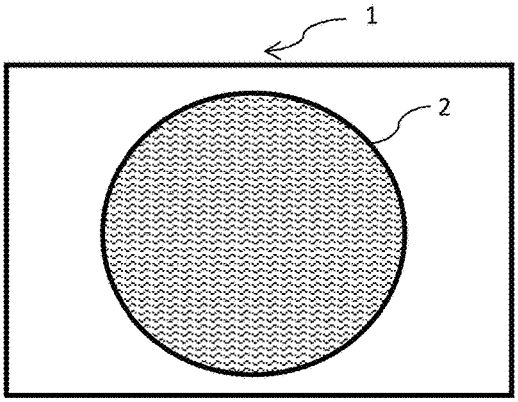
FIGS. 2A to 2D are schematic plan views of an abrasive layer of an abrasive sponge.

One exemplary method for manufacturing the abrasive sponge 1 comprises the steps of applying a cross-linking agent (not shown) on least a portion 2 of a surface 3 of a foam body 4 and curing the cross-linking agent to form an abrasive layer 5 on the at least a portion of a surface 3 of the foam body 4. Preferably, the abrasive layer 5 may be discontinuous, i.e. it does not cover the whole surface 3. Physical properties such as hardness of the abrasive layer 5 may be measured to determine that the cross-linking agent has cured so as to achieve functional properties of the sponge 1. Referring to FIG. 1, the at least a portion 2 comprises a plurality of discrete portions 2. However, in another example, the at least a portion 2 may comprise a single discrete portion 2 as shown in FIG. 2A. Further, the at least a portion may comprise a plurality of dots.

The foam body 4 comprises an open-cell foam material which comprises a flexibility sufficient to be used as a sponge for cleaning. Preferably the open-cell foam material is selected from the group consisting of: polyurethane foam, cellulose foam and polyvinyl alcohol foam. The cross-linking agent comprises one or more cyanoacrylate or isocyanate groups per molecule of cross-linking agent or mixtures thereof for reacting with functional groups on the surface 3 of the foam body 4. Specifically, the cross-linking agent is capable of penetrating, forming cross-links with the foam body 4 and curing at low temperatures in a relatively short time. An advantage of using foam materials selected from the group consisting of: polyurethane foam, cellulose foam and polyvinyl alcohol foam is that these foam materials are widely available in the market.

It will be appreciated that a rate of cure or cure speed will depend on the amount of the cross-linking agent, and a specific chemistry of each of the foam material and the cross-linking agent used to develop the desired functional properties of the sponge 1 such as a hardness of the abrasive layer 5. Preferably, the cross-linking agent may be cured at a temperature between about 10° C. to about 50° C., preferably between about 20° C. to about 40° C. For example, the cross-linking agent may be cured at a temperature between 10° C. to 50° C. in a curing time of from about 0.1 minutes (6 seconds) to about 30 minutes, preferably 0.2 minutes (12 seconds) to about 5 or 10 minutes. In particular, the cross-linking agent may be cured in about 0.2 minutes (20 seconds) at room temperature (approximately 25° C.).

By incorporating the cross-linking agent comprising one or more cyanoacrylate or isocyanate groups on a surface of the foam body 4, the cross-linking agent reacts with the surface of the foam body 4 to swell and/or harden the surface of the foam body 4 at the portions 2. Swelling of the foam body 4 may depend on an amount of the cross-linking agent, optionally addition of an amount of a solvent, or both. Referring to FIG. 1A which shows a portion of the foam cell structure of the foam body 4, the foam body 4 comprises foam struts 40 with which the cross-linking agent reacts and forms at least part of the foam struts 40 and creates the abrasive layer 5. In particular, the hardened foam struts 40 (where the cross-linking agent is applied) form the abrasive layer 5 which comprises sharp or needled edges and a hardness sufficient to provide excellent abrasive cleaning properties while provide good surface safety, i.e. relatively less damage to the hard surfaces.

Figure 1B:
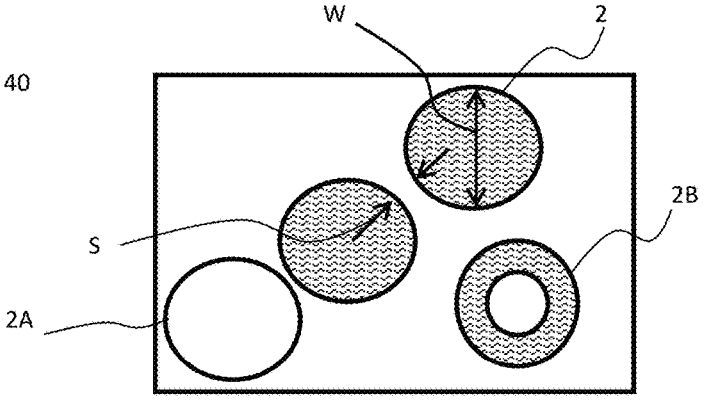
FIG. 1B is a schematic plan view of a portion of the abrasive sponge of FIG. 1.
Figure 1C:
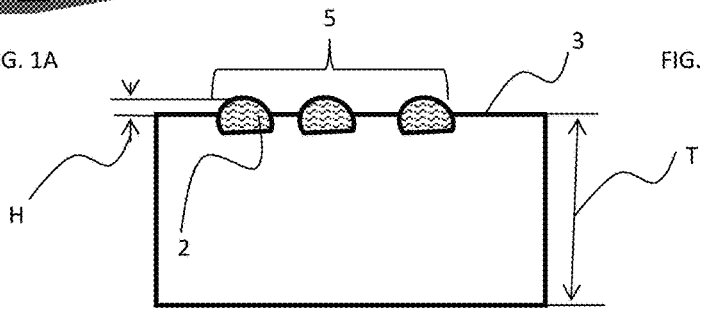
FIG. 1C is a schematic side view of a portion of the abrasive sponge of FIG. 1.

Referring to FIG. 1C, the swelling of the foam body 4 also causes the portions 2 of the foam body 4 to rise above the surface 3 of the foam body 4 to a height (H) relative to the surface 3. For example after curing, the portions 2 may result in an abrasive layer which comprises an average height H of 5% to 20% of a thickness (T) of the sponge 1 depending on an amount of the cross-linking agent applied to the at least one portion 2. Preferably, the abrasive layer has an average height H of from about 2 mm to about 20 mm, preferably from about 5 mm to about 10 mm, more preferably from about 5 mm to 8 mm relative to the surface 3 of the foam body 4 without deforming the foam body 4. Referring to FIG. 1C, the average H may be measured from a tip of at least an abrasive portion defining the abrasive layer by non-contact measurement methods so as to avoid compression of the sponge or with a microscope using methods known to the skilled person. The physical properties of the foam body 4 are also modified by the hardened foam struts accordingly which results in an abrasive sponge 1 with improved properties like abrasiveness and hardness relative to a conventional foam sponge.

Further, the method provides a simple and fast way of making an abrasive sponge for cleaning as the method does not require additional lamination, deposition or gluing of a scouring pad to a foam body. Such advantageous effect cannot be achieved by simply depositing epoxy resin on the foam body as the epoxy resin would take a longer time to cure at room temperature (if curable) and if it is cured at higher temperatures such as 125° C. for a short time such as 5 minutes, this may alter a colour of foam materials such as for example, cellulose and polyurethane foams which may lead to reduced consumer satisfaction especially if it differs greatly from the colour of conventional foam sponges.

The invention also relates to the abrasive sponge 1 obtained by the method according to the present invention. Specifically, as mentioned in the above description, the abrasive sponge 1 comprises modified foam struts or hardened foam struts which form a plurality of sharp edges in the abrasive layer 5. Advantageously, the abrasive sponge 1 manufactured according to the above method has an abrasive layer which has a hardness suitable for effective cleaning of dish surfaces or household surfaces (hereinafter, collectively 'hard surfaces') while having in-situ sharp edges for cleaning without damage to the hard surfaces. The sharp edges may be measured using known measurement instruments such as SEM (scanning electron microscope), or a microscope.

Referring to FIG. 1, the abrasive sponge 1 comprises a first side 10 and a second side 11 opposite the first side 10, the first and second sides 10, 11 defining a thickness (T) of the sponge 1. The abrasive layer 5 may cover about 1%, 10% or 20% to about 60%, 80%, 95% or 100% of the first or second side of the sponge for controlling an abrasive property of the sponge. The abrasive layer 5 may comprise from about 20% to about 60% of a surface area of the surface 3 of the foam body 4. The abrasive layer 5 may comprise a Shore® D hardness from about 40 to about 90, preferably from about 50 to about 80.

Preferably, the foam body 4 may comprise a foam material comprising a pore size from about 200 μm to 5000 μm, preferably from about 300 μm to about 2000 μm, more preferably from about 400 μm to about 1000 μm, and wherein the at least a portion comprises an amount of cross linking agent from about 5 mg to about 250 mg, preferably from about 10 mg to about 200 mg, more preferably from about 15 mg to 150 mg, most preferably from about 50 mg to about 100 mg. The pore size of the foam body 4 may be measured by a microscope or Visiocell software according to methods known by the skilled person.

An advantage of the combination of the pore size and the amount of cross-linking agent per dot achieves effective abrasive cleaning performance and acceptable safety profile of the hard surfaces to which the abrasive sponge 1 is applied. In particular, if the amount of cross-linking agent is too low, i.e. less than 5 mg, there is a risk of the abrasive sponge 1 having insufficient hardness which results in a low cleaning effectiveness. On the other hand, if the amount of cross-linking agent is too high, the cross-linking agent may cover/coat/clot the foam struts which reduces the number of sharp edges being formed (also leading to a lower cleaning effectiveness) and clogs the pores which prevent water/soil from passing through the sponge 1. Preferably the amount of cross-linking agent per dot is about 50 mg to achieve a balance between effective abrasive cleaning performance and acceptable safety profile of the hard surfaces to which the abrasive sponge 1 is applied. More preferably, referring to FIG. 1B, the dot may comprise a width (W) of about 10 mm Most preferably, the dot may be a shape selected from the group consisting of: circle, polygon, ellipse and star.

The cross-linking agent may be applied to the foam body in an amount of 25 to 1000, preferably 50 to 500, more preferably about 100 to about 400 grams, of cross linking agent per $m^2$ of the surface of the foam body so as to maintain a porosity and flexibility of the sponge 1 after curing.

Preferably, the plurality of discrete portions may comprise a density of from about 100 to about 20000, preferably from about 500 to about 10000, more preferably from about 1000 to about 7000, most preferably from about 2000 to about 3000 discrete portions per $m^2$ of the surface of the foam body. In particular, physical properties of the abrasive sponge 1 can be adapted to suit different consumer needs by varying the number of dots in the array so as to vary abrasiveness, hardness and sharp edges of the abrasive layer 5. Therefore, flexibility in manufacturing can be achieved as the same facilities for manufacturing an abrasive sponge with a lower number of dots corresponding to a lower level of abrasiveness (for cleaning surfaces with soft soils) can be easily adapted or reapplied to manufacturing a sponge with a higher number of dots corresponding to a higher level of abrasiveness (for cleaning surfaces with hard soils).

Referring to FIG. 1B, a minimum spacing between edges of two adjacent discrete portions of the plurality of discrete portions is from about 1 mm to about 50 mm, preferably about 2 mm to about 20 mm, more preferably 3 mm to about 10 mm, most preferably about 5 mm to about 7 mm. This provides an abrasive layer which is discontinuous and comprises a plurality of discrete and disconnected abrasive regions or portions on the foam surface. Having a discontinuous abrasive layer enables an abrasive sponge of the present invention to have substantially similar flexibility and water absorption/release properties of conventional foams or sponges for cleaning by consumers. The at least a portion 2 may be a line shape (2A) or lines circumscribing an area (2B) or a solid shape 2.

The cross-linking agent may be applied on the at least a portion is selected from the group consisting of: an array of shapes, a random pattern of shapes, a predetermined pattern arranged to form a logo comprising one or at least two of: a graphic mark, letters, a word on the surface of the foam body, and combinations thereof.

Figure 2B:
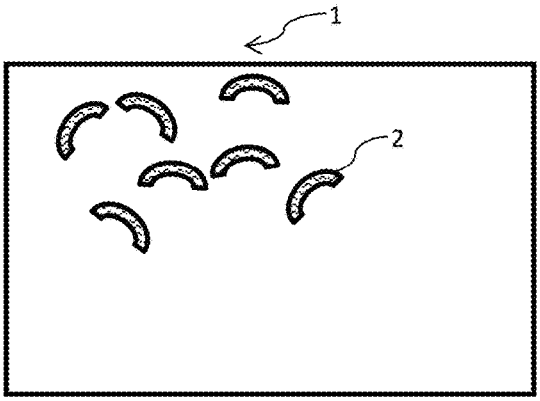
Figure 2C:
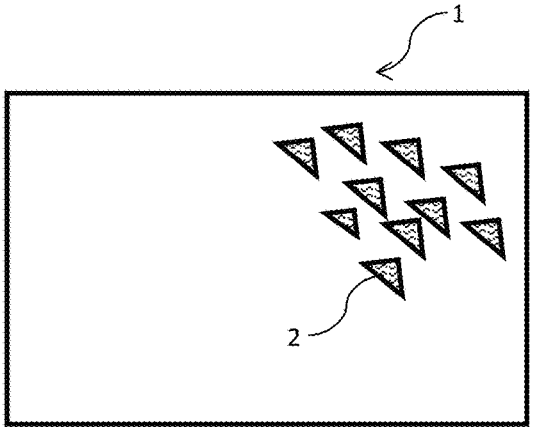

The cross-linking agent may be applied in a single portion as shown in FIG. 2A or in various organized or random patterns as shown in FIGS. 2B and 2C.

Figure 2D:
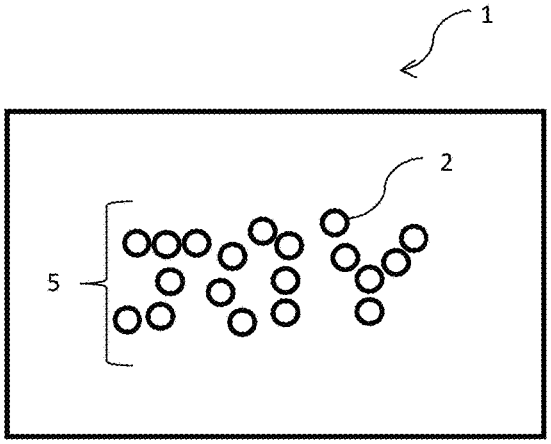

Referring to FIG. 2D, the abrasive layer 5 may comprise a plurality of abrasive dots arranged to form a logo comprising one or at least two of: a graphic mark, letters, a word and combinations thereof. The abrasive layer 5 may comprise abrasive portions which are in one of: an array of shapes, a random pattern of shapes, a predetermined pattern arranged to form a logo comprising one or at least two of: a graphic mark, letters, a word on the surface of the foam body.

The at least a portion may comprise one of: a line, a curve, an area comprising a shape selected from the group consisting of: a circle, square, rectangle, diamond, triangle, star, chevron, and combinations thereof. An advantage is that a pattern of the abrasive layer 5 can be customized for marketing needs such as to communicate the brand of the sponge 1 as well as to visually indicate to a consumer a level of abrasiveness of the sponge 1, i.e. its functional features.

The cross-linking agent may be applied on the surface of the foam body by one of: liquid dispensing, spraying, printing, rolling. An advantage is the abrasive layer can be produced in-situ during the production of the foam body in an easy way as a final step after the foam body is formed. Further, relatively less factory space is required for storage of the cross-linking agent compared to storage of scouring pads for attachment to the foam body in the making of conventional sponge which leads to reduced capital costs. The methods of liquid dispensing, spraying, printing and rolling may comprise methods for dispensing low viscosity liquids such as adhesives known to the skilled person and therefore will not be further described.

The cross-linking agent may comprise a low viscosity, Brookfield-LVF at 25° C. of from about 1 to about 200, preferably from about 10 to 100, more preferably from about 20 to 50 centipoises (mPa*s), at 20 $s^{-1}$ and 25° C., using Brookfield LVF, Spindle 1 at speed of 30 rpm. The advantage of the specified viscosity is that it prevents the cross-linking agent from clogging the pores of the foam body, while the crosslinking agent is allowed to sufficiently penetrate the first few millimeters from the surface of the sponge with respect to the thickness of the sponge and to sufficiently spread along the foam struts before the curing occurs.

The cross-linking agent may comprise an aromatic isocyanate, whereas the aromatic part is preferably a toluene or a methylene diphenyl group comprising one or more isocyanate groups. Aromatic diisocyanates are more reactive than aliphatic compounds, and therefore allow faster reaction between the foam and the cross-linking agent at room temperature under atmospheric conditions. Further, aromatic diiocyanates also result in modified foam struts having a higher hardness relative to foam struts modified by applying other types of isocyanates, and having a higher relative hardness improves cleaning performance in a sponge. Preferably, the crosslinking agent is toluene diisocyanate or methylene diphenyl diisocyanate as these compounds are low cost and widely available. Advantageously, the costs of manufacturing may be lower.

The crosslinking agent may comprise a methyl cyanoacrylate, ethyl cyanoacrylate, propyl cyanoacrylate, butyl cyanoacrylate, pentyl cyanoacrylate or hexyl cyanoacrylate and mixture thereof, preferably methyl or ethyl cyanoacrylate. An advantage of using cyanoacrylate cross-linking agents is that it is a one component system which requires no mixing or heating and are fast reacting especially with foams containing amine or hydroxyl residues and efficient at penetrating/swelling a foam body comprising a foam material such as polyurethane, polyvinyl alcohol or cellulose. A desired hardness of the abrasive layer can conveniently achieved by choosing the alkyl cyanoacrylate where methyl cyanoacrylate provides the higher hardness and hexyl cyanoacrylate provides the lowest hardness. In order to achieve the targeted hardness, mixes of alkyl cyanoacrylates can also be used.

A person skilled in the art would appreciate that the foam body is made according to known foam making methods for preparing a foam body comprising polyurethane foam, cellulose foam or polyvinyl alcohol foam, and therefore the foam making methods would not be described. The foam body may have a density of from about 10 kg/m$^3$ to about 250 kg/m$^3$, preferably from about 20 kg/m$^3$ to about 100 kg/m$^3$, more preferably from about 30 to 70 kg/m$^3$.

Catalysts

An exemplary method may comprise applying a catalyst to the surface of the foam body prior to applying the cross-linking agent. The catalyst enables a cross-linking reaction between the cross-linking agent and the foam body to be carried out in a faster, controlled and balanced manner. In particular, the catalyst forms an activated complex with the cross-linking agent and the foam body therefore making it easier for the cyanoacrylate or isocyanate groups of the cross-linking agent to chemically react with the functional groups of the foam body. The catalyst may be selected from the group consisting of: water, an inorganic base, an organic amine, a tertiary amine, a tin catalyst, and mixtures thereof. Preferably, the catalyst may be an inorganic base such as sodium bicarbonate, an organic amine such as tertiary amine, a tin catalyst such as alkyl tin carbonate, or mixtures thereof. In particular, Table 1 below shows examples of known amine catalysts which are suitable for use in the present invention, and respective physical properties of the amine catalysts.

TABLE 1

| JEFFCAT ® catalyst | Description | Typical Properties: OH Number Mg KOH/g | Viscosity 78° F. (25° C.) cSt | Flast Point °F. PMCC | Specific Gravity 68/68° F. |
|---|---|---|---|---|---|
| | GENERAL PURPOSE CATALYSTS | | | | |
| ZF-20 | 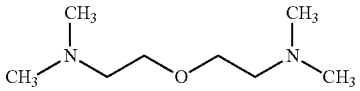 Bis-(2-dimethylaminoethyl)ether- A very strong, highly efficient blowing catalyst. | | 1 | 165 | 0.9 |
| ZF-22 | 70% ZP-20 in dipropylene glycol | 251 | 4 | 170 | 0.9 |
| ZF-24 | 23% ZF-20 in dipropylene glycol | 644 | 36 | 213 | 1.0 |
| ZF-26 | 11% ZF-20 in dipropylene glycol | 744 | 56 | 228 | 1.0 |
| ZF-123 | 35% ZF-20 in a 3000 MW triol | 36 | 50 | 177 | 1.0 |
| ZF-125 | 35% ZF-20 in a high viscosity reactive diluent | 10 | 158 | 168 | 1.0 |
| ZF-167 | 47% ZF-20 in dipropylene glycol | 444 | 44 | 180 | 1.0 |
| DMEA | 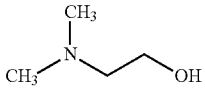 N,N-dimethylethanolamine | 629 | 4 | 113 | 0.9 |
| TD-33A | 33% TEDA in dipropylene glycol | 558 | 104 | 203 | 1.0 |
| TD-20 | 20% TEDA in DMEA-Ideal for many rigid foams. Low-cost alternative for flexible applications. | 503 | 7 | 125 | 0.9 |
| BDMA | 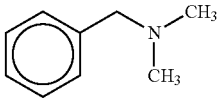 Benzyldimethylamine | | 1 | 141 | 0.9 |
| DMCHA | 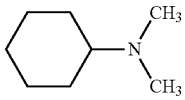 N,N-dimethylcyclohexylamine-Widely used catalyst for all types of rigid foams. | | 1 | 127 | 0.9 |

TABLE 1-continued

| JEFFCAT ® catalyst | Description | Typical Properties: OH Number Mg KOH/g | Viscosity 78° F. (25° C.) cSt | Flast Point °F. PMCC | Specific Gravity 68/68° F. |
|---|---|---|---|---|---|
| PMDETA | 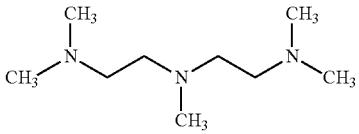 Pentamethyldiethylenetifamine-Especially useful as catalyst for HCFC/water-blown rigid foams. | | 2 | 194 | 0.8 |
| ZR-40 | 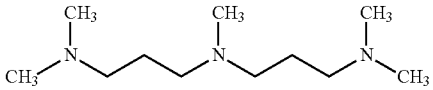 N,N,N',N'',N''-pentamethyl-dipropylenetriamine-Very useful in cold-molded HR foams, Low odor catalyst with a good balance between gel and blow. | | 3 | 208 | 0.8 |
| LOW EMISSION CATALYSTS/REACTIVE CATALYSTS | | | | | |
| ZF-10 | 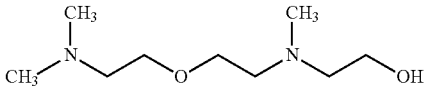 N,N,N'-trimethyl-N'-hydroxyethyl-bisaminoethylether-Strong blowing catalyst that is highly efficient. Used in foams requiring low emission. | 295 | 12 | 261 | 1.0 |
| LE-210 | Reactive gel catalyst which can replace 33% TEDA on an equivalent part basis, Can be used in a wide variety of flexible slabstock and high resiliency (HR) foam grades. | 514 | 37 | 158 | 0.9 |
| LED-103 | Reactive, acid blocked, low emissions type blowing catalyst that offers improved material handiling, low-corrosion, and phase stability in fully formulated B-side flexible molded foams. In automotive applications, foams made with this catalyst exhibit lower vinyl staining, lower fogging, and lower emissions. | 2405 | 104 | >370 | 1.1 |
| Z-131 | Blend of low emission, reactive gelling amine catalysts | 407 | 21 | 201 | 0.9 |
| LED-204 | Reactive, acid blocked, low emissions, low-corrosion type gelling catalyst used in all types of flexible molded foams. Reduces vinyl staining, fogging and emissions in automotive foam. | 2,555 | 1856 | >370 | 1.1 |
| LE-425 | Formulated blend of reactive blowing and gelling catalysts. | 460 | 26 | 171 | 0.9 |
| ZR-50 | 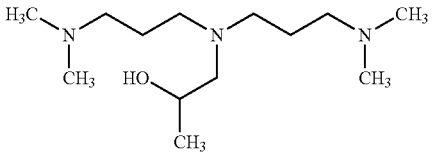 N,N-bis(3-dimethylarninopropyl)-N-isopropanoiamine-Low emission with exceptional balance and versatility. | 229 | 17 | 269 | 0.9 |
| DPA | 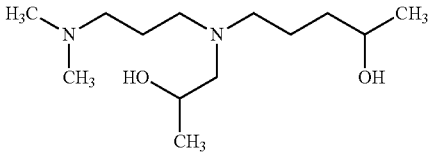 N-(3-dimethylaminopropyl)-N,N-diisopropanolamine-Low emission catalyst with good gellation and flowability. | 514 | 145 | 284 | 1.0 |

TABLE 1-continued

| JEFFCAT ® catalyst | Description | Typical Properties | | | |
|---|---|---|---|---|---|
| | | OH Number Mg KOH/g | Viscosity 78° F. (25° C.) cSt | Flast Point °F. PMCC | Specific Gravity 68/68° F. |
| Z-130 | 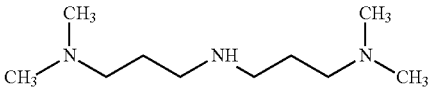 1,3-propanediamine, N'-(3-(dimethylamino) propyl)-N,N-dimethyl-Low emission reactive gel catalyst. | 299 | 3 | 206 | 0.8 |
| ZR-70 | 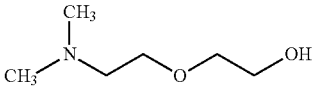 2-(2-dimethylaminoethoxy)ethanol-For use in packaging foam applications. | 421 | 8 | 206 | 1.0 |
| Z-110 | 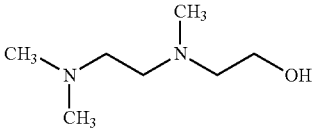 N,N,N'-trimethylarninoethyl-ethanolamine-Used in a variety of polyurethane foam applications. | 384 | 8 | 195 | 0.9 |

Solvents/Dyes/Pigments

The method may further comprising adding, at least one of: a solvent, a dye and a pigment, to the cross-linking agent whereby the solvent comprises one of: acetone, toluene or methyl ethyl ketone, methyl acetate, dichloromethane tetrahydrofuran, and a low boiling point alkane selected from the group consisting of: a pentane, cyclopentane, hexane, cyclohexane and mixtures thereof.

A solvent may be used to adjust the viscosity and ease the dispensing or spreading of cross-linking agents such as cross-linking agents which have high inherent viscosity or low chemical affinity with the foam material of the foam body. Incidentally the use of solvent may boost the penetration or swelling of the foam body by the cross-linking agent. In particular, partial penetration/swelling is also effective in generating the abrasive layer on the foam body.

The solvent can be selected accordingly to Hansen solubility parameters (hereinafter "HSP parameters") of a desired foam material. Specifically, HSP parameters are defined by dispersion bonds (δD), polar bonds (δP) and hydrogen bonds (δH) which contain information about the inter-molecular interactions with other solvents and also with polymers, pigments, nanoparticles, or the like. This allows for rational formulations knowing, for example, that there is a good HSP match between a solvent and the foam material wherein a suitable solvent is considered to have a HSP distance below 8 and not contain any reacting group to the cross-linking agent, such as for example, hydroxyl, amine, or the like. Separately, when choosing a solvent to help viscosity and dispensing for fast reacting cross-linking agents which are also good penetrating and/or swelling cross-linking agent, it is preferable to use fast evaporating solvents.

A dye or a pigment may be added to the cross-linking agent prior to applying the cross-linking agent and curing thereof so as to provide a colour to the abrasive layer so as to create an aesthetically appealing appearance to consumers as well as to convey a visual message to consumers, the different functions of an abrasive sponge. For example, the abrasive layer on the sponge may be of a first colour to represent a specific degree of abrasive action whereas a foam portion of the sponge different from the abrasive layer may be of a second colour to represent non-abrasive action.

METHOD OF CLEANING

The present invention further relates to a method of cleaning a dish surface comprising soil on the dish surface with an abrasive sponge made according to the method according to the present invention. In particular, the method comprises the steps of wetting the sponge with water, applying a dishwashing detergent composition, preferably liquid hand dishwashing liquid composition, typically in diluted or neat form to the sponge, and contacting the soiled surface of the dish with a sponge according to the present invention. The sponge may be immersed in the detergent composition and water mixture prior to being contacted with the dish surface. The contacting of the sponge to the dish surface is preferably accompanied by a concurrent scrubbing of the dish surface.

EXAMPLES

Examples shown herein are to exemplify the present invention, but are not necessarily used to limit or otherwise define the scope of the present invention. Specifically, an abrasive sponge 1 according to the present invention ("Inventive Example") comprises a foam body 4 made of a polyurethane foam material and a cross-linking agent (ethyl cyanoacrylate) deposited to a surface of the foam body 4 in an array of dots to form a discontinuous abrasive layer as shown in FIG. 1 upon curing. The amount of crosslinking agent per dot is 50 mg and the size of the dot is about 10 mm. The dot density is 5000 dots/$m^2$. No solvent is used as the cross-linking agent used (ethyl cyanoacrylate) has a low viscosity and is an excellent penetration and/or swelling agent of the polyurethane foam. Comparative Examples are prepared based on providing a scouring side of a commercially available Spontex sponge (Comparative Example #1) and a cellulose sponge (Comparative Example #2).

The cleaning effectiveness is evaluated based on the following Cleaning Effectiveness Test Method. The cleaning effectiveness or ability of a sponge to remove greasy soap scum is measured through the number of strokes needed to clean the surface, as determined by visual assessment. The lower the number of strokes, the higher the greasy soap scum cleaning ability of the sponge.

Cleaning Effectiveness Test Method

Ceramic tiles (typically glossy, white, ceramic 24 cm×4 cm) are covered with 0.3 g of typical greasy soap scum soils comprising calcium stearate and artificial body soils commercially available (applied to the tile via a sprayer). The soiled tiles are then dried in an oven at a temperature of 140° C. for about 10 to about 45 minutes, preferably 40 minutes and then aged between 2 and 12 hours at room temperature (around 20° C.) in a controlled environment humidity (60-85% Relative Humidity (RH), preferably 75% RH). Then the soiled tiles are cleaned according to the following steps ("Cleaning Protocol"):

a) using 5 ml of the cleaning lotion (liquid detergent composition or water) which is poured directly on the abovementioned abrasive sponge pre-wetted with water.
b) The sponge is then mounted on a Wet Abrasion Scrub Tester Instrument (such as made by Sheen Instruments Ltd. Kingston, England, hereinafter "abrasion tester"). The abrasion tester can be configured to supply pressure (e.g. a weight of 600 g (0.6 kg) is mounted to the abrasion tester), and
c) move the sponge over the test surface with a set stroke length (e.g. 30 cm), at set speed (e.g.: 37 strokes per minute).

The sponge is tested on the above-mentioned greasy soap scum soil type. The tile #1 is cleaned with a liquid detergent composition (tile #1). After cleaning tile #1, the sponge is squeezed and rinsed under the running tap water for about 5 to 10 secs or hand squeezed prior to cleaning tile #2. When cleaning tile #2, water is used in the Cleaning Protocol instead of using the liquid detergent composition. The Cleaning Protocol for the tiles #3-19 is identical as per the tile #2. Results of the test of selected tiles are shown in Table 3 below.

TABLE 3

| Number of strokes to clean greasy soap scum | Tile #1 | Tile #5 | Tile #10 | Tile #15 | Tile #19 |
|---|---|---|---|---|---|
| Crosslinked sponge (Inventive Example) | 12 | 16 | 28 | 44 | 86 |
| Sponge B-Spontex sponge (Scrubbing side)-Comparative Example #1) | 34 | 44 | >100 | >100 | >100 |
| Sponge C-Cellulose sponge (Comparative Example #2) | >100 | >100 | >100 | >100 | >100 |

As seen from results in the above Table 3, the sponge according to the present invention, i.e. the Inventive Example requires a lesser number of cleaning strokes relative to Comparative Examples #1 and #2. Advantageously, the Inventive Example provides effective cleaning of the surfaces in view of improved hardness of the sponge through the abrasive layer and presence of the sharp edges on the abrasive layer of the Inventive Example. Further, as less number of cleaning strokes is required to clean, there is less scrubbing and according the risks of surface damage is reduced relative to use of a sponge that requires a higher number of cleaning strokes.

In an example, there is:

A. A method of manufacturing an abrasive sponge for cleaning, the method comprising the steps of:
a) applying a cross-linking agent comprising one or more cyanoacrylate or isocyanate groups per molecule of cross-linking agent or mixtures thereof on at least a portion of a surface of a foam body comprising an open-cell foam material; and
b) curing the cross-linking agent to form an abrasive layer on the at least a portion of a surface of the foam body.

B. The method according to A, wherein the open-cell foam material is selected from a group consisting of: polyurethane foam, cellulose foam and polyvinyl alcohol foam.

C. The method according to A, wherein the cross-linking agent is cured at a temperature between about 10° C. to about 50° C., preferably between about 20° C. to about 40° C.

D. The method according to A, wherein the foam material comprises a pore size from about 200 μm to 5000 μm, preferably from about 300 μm to about 2000 μm, more preferably from about 400 μm to about 1000 μm, and wherein the at least a portion comprises an amount of cross linking agent from about 5 mg to about 250 mg, preferably from about 10 mg to about 200 mg, more preferably from about 15 mg to 150 mg, most preferably from about 50 mg to about 100 mg.

E. The method according to A, wherein step (a) comprises applying the cross-linking agent to the foam body in an amount of 25 to 1000, preferably 50 to 500, more preferably about 100 to about 400 grams, of cross linking agent per $m^2$ of the surface of the foam body.

F. The method according to A, wherein the at least a portion comprises a plurality of discrete portions.

G. The method according to F wherein the plurality of discrete portions has a density of from about 100 to about 20000, preferably from about 500 to about 10000, more preferably from about 1000 to about 7000, most preferably from about 2000 to about 3000 discrete portions per $m^2$ of the surface of the foam body.

H. The method according to G, wherein a minimum spacing between edges of two adjacent discrete portions of the plurality of discrete portions is from about 1 mm to about 50 mm, preferably about 2 mm to about 20 mm, more preferably 3 mm to about 10 mm, most preferably about 5 mm to about 7 mm.

I. The method according to A, wherein the at least a portion is selected from the group consisting of: an array of shapes, a random pattern of shapes, a predetermined pattern arranged to form a logo comprising one or at least two of: a graphic mark, letters, a word on the surface of the foam body, and combinations thereof.

J. The method according to A, wherein the cross-linking agent is applied by one of: liquid dispensing, spraying, printing, rolling.

K. The method according to A, further comprising applying a catalyst selected from, the group consisting of: water, an inorganic base, an organic amine, a tertiary amine, a tin catalyst, and mixtures thereof, to the surface of the foam body prior to step (a) of applying the cross-linking agent.

L. The method according to K, wherein the catalyst is selected from the group consisting of: sodium bicarbonate, tertiary amine, alkyl tin carbonate and mixtures thereof.

M. The method according to A, wherein the cross-linking agent comprises a viscosity of from about 1 to about 200, preferably from about 10 to 100, more preferably from about 20 to 50 centipoises (mPa*s), at 20 $s^{-1}$ and 25° C.

O. The method according to A, further comprising adding, at least one of: a solvent, a dye and a pigment, to the cross-linking agent whereby the solvent comprises one of: acetone, toluene or methyl ethyl ketone, methyl acetate, dichloromethane tetrahydrofuran, and a low boiling point alkane selected from the group consisting of: a pentane, cyclopentane, hexane, cyclohexane and mixtures thereof.

P. The method according to A, wherein the cross-linking agent comprises an aromatic isocyanate, whereas the aromatic part is a toluene or a methylene diphenyl group comprising one or more isocyanate groups.

Q. The method according to P, wherein the crosslinking agent is toluene diisocyanate or methylene diphenyl diisocyanate.

R. The method according to A, wherein the crosslinking agent is a methyl cyanoacrylate, ethyl cyanoacrylate, propyl cyanoacrylate, butyl cyanoacrylate, pentyl cyanoacrylate or hexylcyanoacrylate and mixture thereof, preferably methyl or ethyl cyanoacrylate.

S. The method according to A, wherein the foam body comprises a density of from about 10 to about 250, preferably from about 20 to about 100, more preferably from about 30 to 70 kg/$m^3$.

T. An abrasive sponge made according to a method according to A, wherein the cross-linking agent is incorporated in the foam body to react with the at least one portion and form at least a part of the surface of the foam body.

U. The abrasive sponge according to T, wherein the abrasive layer comprise a plurality of modified foam struts, wherein at least a part of the plurality of modified foam struts extend above the surface of the foam body.

V. The abrasive sponge according to T, wherein the sponge comprises a first side and a second side opposite the first side, the first and second sides defining a thickness of the sponge, wherein the abrasive layer covers about 1% to about 90% of the first or second side of the sponge.

W. The abrasive sponge according to T wherein the abrasive layer comprises a Shore® D hardness from about 40 to about 90, preferably from about 50 to about 80.

X. A method of cleaning a hard surface comprising soil on the hard surface, the method comprising:

a) wetting a sponge made according to a method according to A with water;
b) applying liquid detergent composition to the sponge; and
c) moving the sponge on the hard surface to remove the soil.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of manufacturing an abrasive sponge for cleaning, the method comprising the steps of:

a) applying a cross-linking agent comprising one or more cyanoacrylate or isocyanate groups per molecule of cross-linking agent or mixtures thereof on at least a portion of a surface of a foam body comprising an open-cell foam material in an amount of 25 to 1000 grams of cross linking agent per $m^2$ of the surface of the foam body; and
b) curing the cross-linking agent to form an abrasive layer on the at least a portion of a surface of the foam body.

2. The method according to claim 1, wherein the open-cell foam material is selected from a group consisting of: polyurethane foam, cellulose foam and polyvinyl alcohol foam.

3. The method according to claim 1, wherein the foam material comprises a pore size from about 200 μm to 5000 μm, and wherein the at least a portion comprises an amount of cross linking agent from about 5 mg to about 250 mg.

4. The method according to claim 1, wherein the at least a portion comprises a plurality of discrete portions.

5. The method according to claim 4, wherein the plurality of discrete portions has a density of from about 100 to about 20000 discrete portions per $m^2$ of the surface of the foam body.

6. The method according to claim 5, wherein a minimum spacing between edges of two adjacent discrete portions of the plurality of discrete portions is from about 1 mm to about 50 mm.

7. The method according to claim 1, wherein the at least a portion is selected from the group consisting of: an array of shapes, a random pattern of shapes, a predetermined pattern arranged to form a logo comprising one or at least two of: a graphic mark, letters, a word on the surface of the foam body, and combinations thereof.

8. The method according to claim 1, further comprising applying a catalyst to the surface of the foam body prior to step (a) of applying the cross-linking agent, wherein the catalyst is selected from the group consisting of: water, an inorganic base, an organic amine, a tertiary amine, a tin catalyst, and mixtures thereof.

9. The method according to claim 8, wherein the catalyst is selected from the group consisting of: sodium bicarbonate, tertiary amine, alkyl tin carbonate and mixtures thereof.

10. The method according to claim 1, wherein the cross-linking agent comprises a viscosity of from about 1 to about 200 centipoises (mPa*s), at 20 $s^{-1}$ and 25° C.

11. The method according to claim 1, further comprising adding at least one of: a solvent, a dye, and a pigment, to the cross-linking agent whereby the solvent comprises one of: acetone, toluene or methyl ethyl ketone, methyl acetate, dichloromethane tetrahydrofuran, and a low boiling point alkane selected from the group consisting of: a pentane, cyclopentane, hexane, cyclohexane and mixtures thereof.

12. The method according to claim 1, wherein the cross-linking agent comprises an aromatic isocyanate, whereas the aromatic part is a toluene or a methylene diphenyl group comprising one or more isocyanate groups.

13. An abrasive sponge made according to the method of claim 1, wherein the cross-linking agent is incorporated in the foam body to react with the at least one portion and form at least a part of the surface of the foam body.

14. The abrasive sponge according to claim 13, wherein the abrasive layer comprises a plurality of modified foam struts, wherein at least a part of the plurality of modified foam struts extend above the surface of the foam body.

15. The abrasive sponge according to claim 13, wherein the sponge comprises a first side and a second side opposite the first side, the first and second sides defining a thickness of the sponge, wherein the abrasive layer covers about 1% to about 90% of the first or second side of the sponge.

16. The abrasive sponge according to claim 13 wherein the abrasive layer comprises a Shore® D hardness from about 40 to about 90.

17. A method of manufacturing an abrasive sponge for cleaning, the method comprising the steps of:

a) applying a cross-linking agent comprising one or more cyanoacrylate or isocyanate groups per molecule of cross-linking agent or mixtures thereof on at least a portion of a surface of a foam body comprising an open-cell foam material, wherein the cross-linking agent is cured at a temperature between about 10° C. to about 50° C.; and b) curing the cross-linking agent to form an abrasive layer on the at least a portion of a surface of the foam body.

18. A method of manufacturing an abrasive sponge for cleaning, the method comprising the steps of:

a) applying a cross-linking agent on at least a portion of a surface of a foam body comprising an open-cell foam material, wherein the crosslinking agent is selected from the group consisting of: a methyl cyanoacrylate, ethyl cyanoacrylate, propyl cyanoacrylate, butyl cyanoacrylate, pentyl cyanoacrylate or hexylcyanoacrylate and mixtures thereof; and b) curing the cross-linking agent to form an abrasive layer on the at least a portion of a surface of the foam body.

* * * * *